US006931219B2

(12) United States Patent
Viturro et al.

(10) Patent No.: US 6,931,219 B2
(45) Date of Patent: Aug. 16, 2005

(54) LED COLOR SPECIFIC OPTICAL TONER CONCENTRATION SENSOR

(75) Inventors: R. Enrique Viturro, Rochester, NY (US); Michael D. Borton, Ontario, NY (US); Eric M. Gross, Rochester, NY (US); Eric S. Hamby, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/607,212

(22) Filed: Jun. 26, 2003

(65) Prior Publication Data

US 2004/0264983 A1 Dec. 30, 2004

(51) Int. Cl.[7] ..... G03G 15/10
(52) U.S. Cl. ..... 399/64; 399/62
(58) Field of Search ..... 399/24, 27, 28, 399/30, 58, 61, 62, 64, 223

(56) References Cited

U.S. PATENT DOCUMENTS 3,610,205 A * 10/1971 Rarey et al. ..... 399/30
4,141,645 A * 2/1979 Reid et al. ..... 399/64 X
4,273,843 A * 6/1981 Fujita et al. ..... 399/64 X
4,550,998 A * 11/1985 Nishikawa ..... 399/30 X
4,980,727 A * 12/1990 Stelter ..... 399/64
4,985,823 A * 1/1991 Tada et al. ..... 399/62 X
5,229,821 A * 7/1993 Fujii ..... 399/28
6,289,184 B1 * 9/2001 Yoo et al. ..... 399/64 X
6,381,421 B1 * 4/2002 Katahira ..... 399/27

OTHER PUBLICATIONS

Copending U.S. Appl. No. 10/012,442, filed Dec. 12, 2001, entitled by "Optical Toner Concentration Sensor," Eric M. Gross et al.

Copending U.S. Appl. No. 10/012,440, filed Dec. 12, 2001, entitled "Developer Composition Having Improved Noise Signal Ratio In An Optical Toner Concentration," by Eric M. Gross et al.

* cited by examiner

*Primary Examiner*—Sandra L. Brase
(74) *Attorney, Agent, or Firm*—Lloyd F. Bean, II

(57) ABSTRACT

An apparatus and method for determining toner concentration of a sample comprised of toner and carrier, including exposing the sample to light; the exposing includes emitting light at a predefined wavelength based upon the color of the toner; detecting the light reflected off the sample with an optical sensor; and determining the toner concentration of the sample base upon the light reflected off the sample.

12 Claims, 12 Drawing Sheets

LED COLOR SPECIFIC OPTICAL TONER CONCENTRATION SENSOR

CROSS-REFERENCE TO RELATED APPLICATION

Reference is made to commonly-assigned copending U.S. patent application Ser. No. 10/607,290, filed concurrently, entitled "COMPENSATING OPTICAL MEASUREMENTS OF TONER CONCENTRATION FOR TONER IMPACTION," by Douglas A. Kreckel et al., the disclosure of which is incorporated herein.

This invention relates generally to a printing machine, and more particularly concerns an apparatus for controlling the concentration of toner in a development system of an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductive member is cleaned by a cleaning device.

In a machine of the foregoing type, it is desirable to regulate the addition of toner particles to the developer material in order to ultimately control the triboelectric characteristics (tribo) of the developer material. However, control of the triboelectric characteristics of the developer material are generally considered to be a function of the toner concentration within the developer material. Therefore, for practical purposes, machines of the foregoing type usually attempt to control the concentration of toner particles in the developer material.

Toner tribo is a very "critical parameter" for development and transfer. Constant tribo would be an ideal case. Unfortunately, it varies with time and environmental changes. Since tribo is almost inversely proportional to Toner Concentration (TC) in a two component developer system, the tribo variation can be compensated for by the control of the toner concentration.

Toner Concentration is conventionally measured by a Toner Concentration (TC) sensor. The problems with TC sensors are that they are expensive, not very accurate, and rely on an indirect measurement technique which has poor signal to noise ratio.

There is provided an apparatus and method for determining toner concentration of a sample comprised of toner and developer, including exposing the sample to light; said exposing includes emitting light at a predefined wavelength based upon the color of said toner; detecting the light reflected off the sample with an optical sensor; and determining the toner concentration of the sample based upon the light reflected off the sample.

Other features of the present invention will become apparent as the following description proceeds and upon reference to the drawings, in which.

Figure 10:
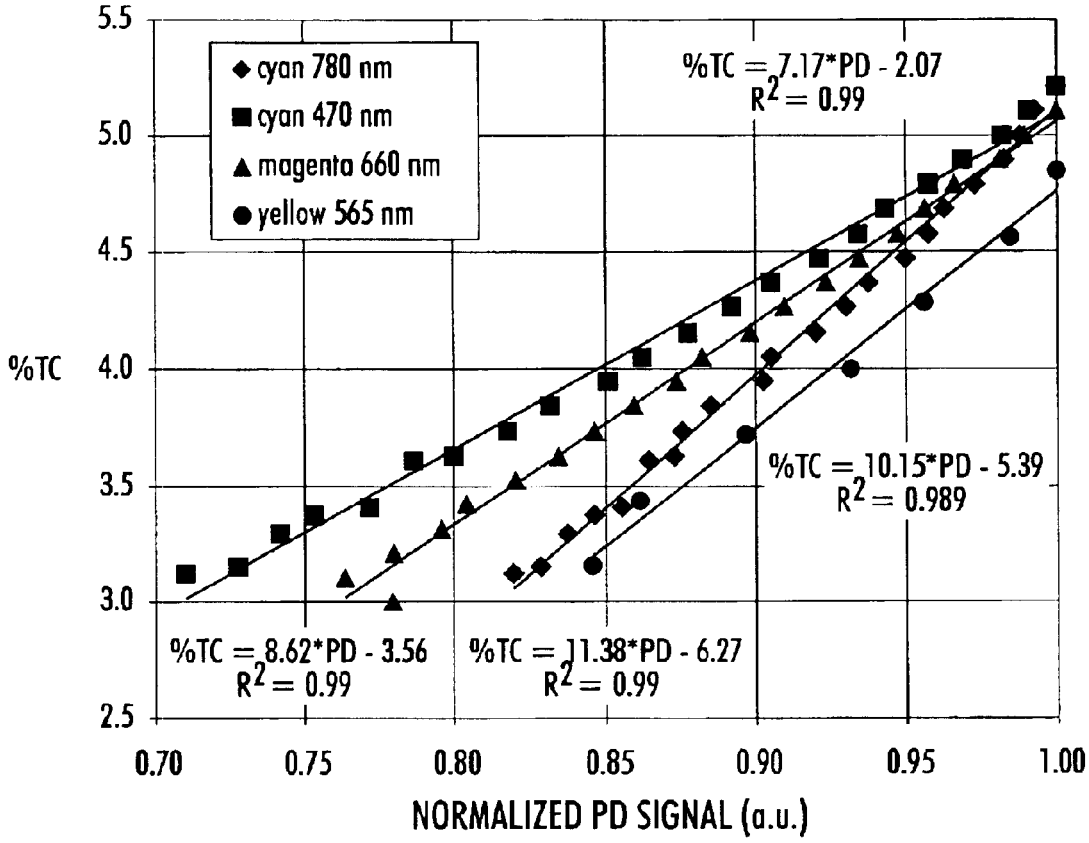
Figure 11:
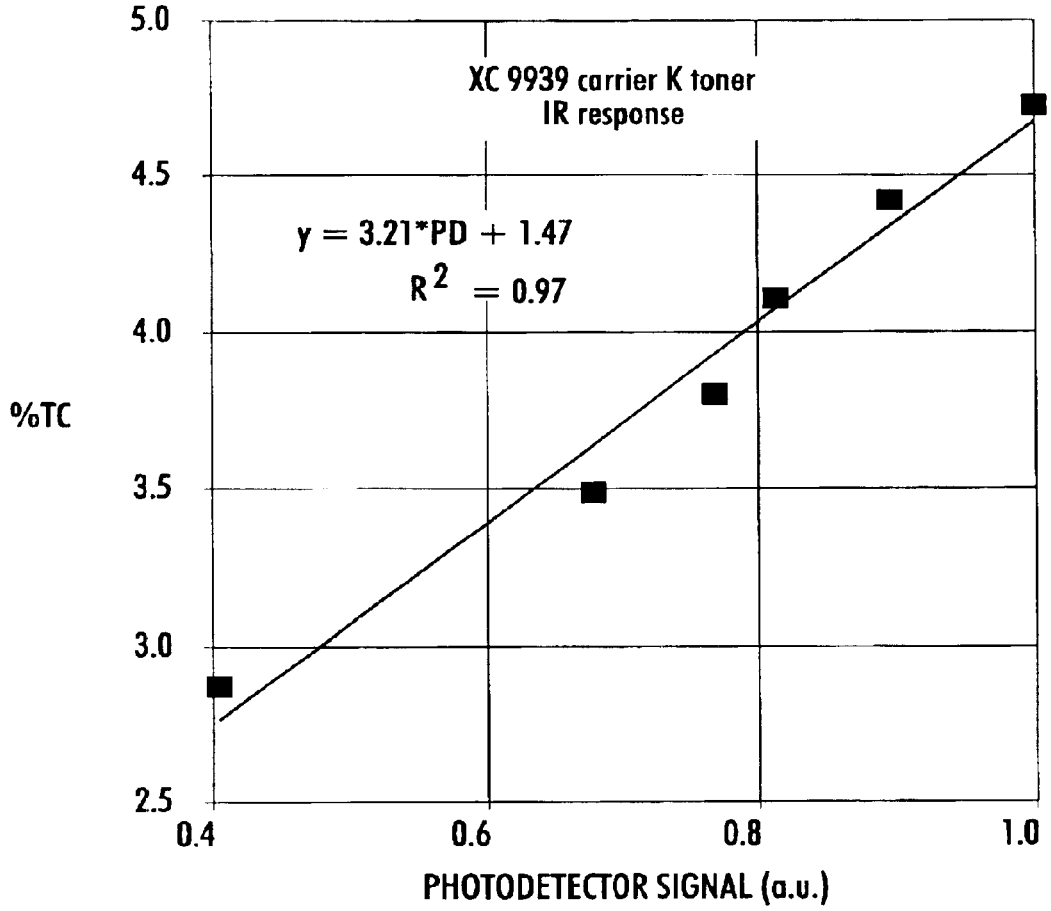
Figure 12:
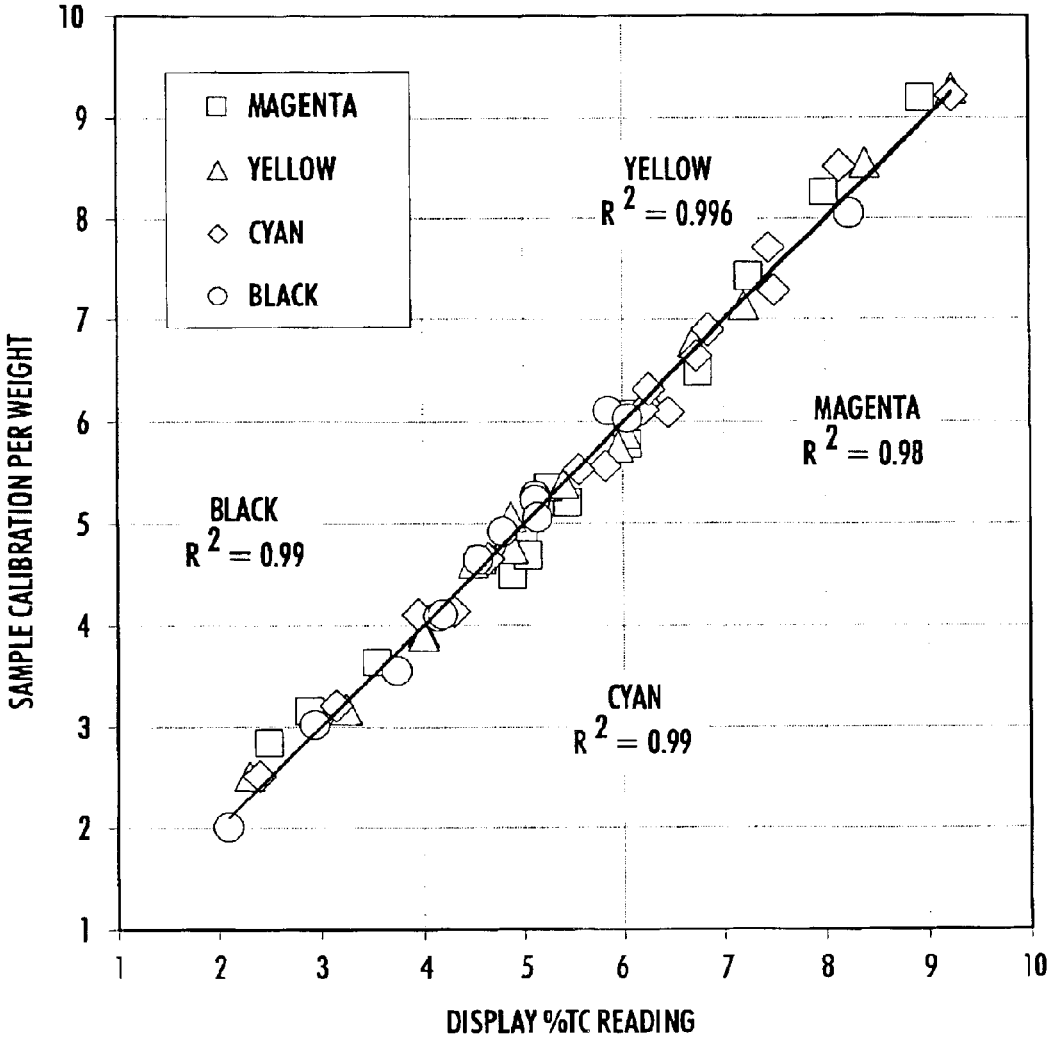

FIG. 10 is a graph showing the results of the calculations and linear fittings of % TC for cyan, magenta, and yellow developers using various LED sources. (a) Solid diamonds: cyan developer with LED 790 nm peak wavelength, (b) solid squares: cyan developer with LED 470 nm peak wavelength, (c) solid triangles: magenta developer with LED 660 nm peak wavelength, and (d) yellow developer with LED 565 nm peak wavelength;

FIG. 11 is a graph showing the results of measuring black developer % TC using an IR LED source at 940 nm peak wavelength; and FIG. 12 is a graph showing experimental results of optical % TC measurements (display % TC readings) of a prototype device for cyan, magenta, yellow and black developers against % TC calibration measurements per weight.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
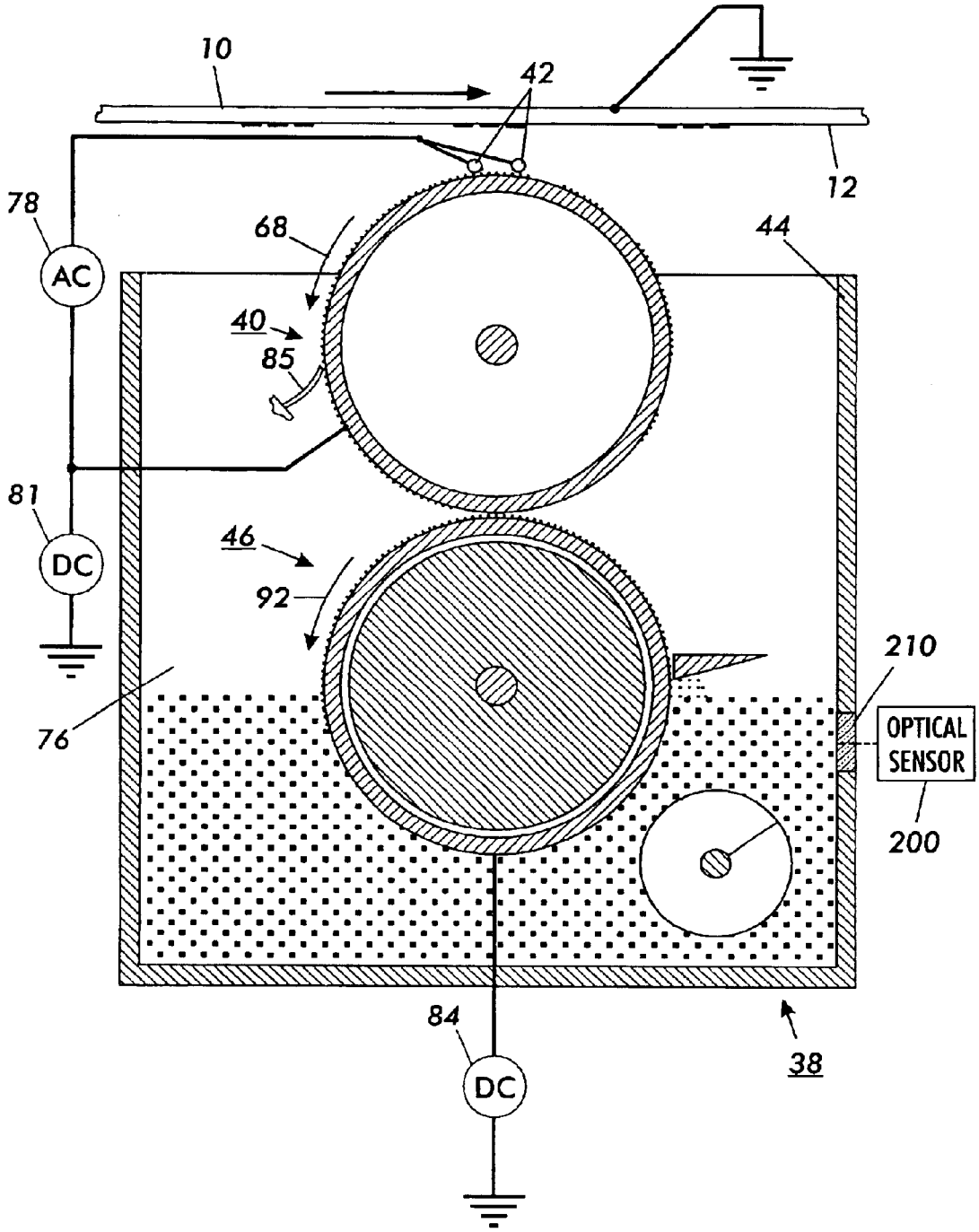
FIG. 1 is a schematic elevational view of a typical electrophotographic printing machine utilizing the toner maintenance system therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the toner control apparatus of the present invention may be employed in a wide variety of devices and is not specifically limited in its application to the particular embodiment depicted herein.

Figure 2:
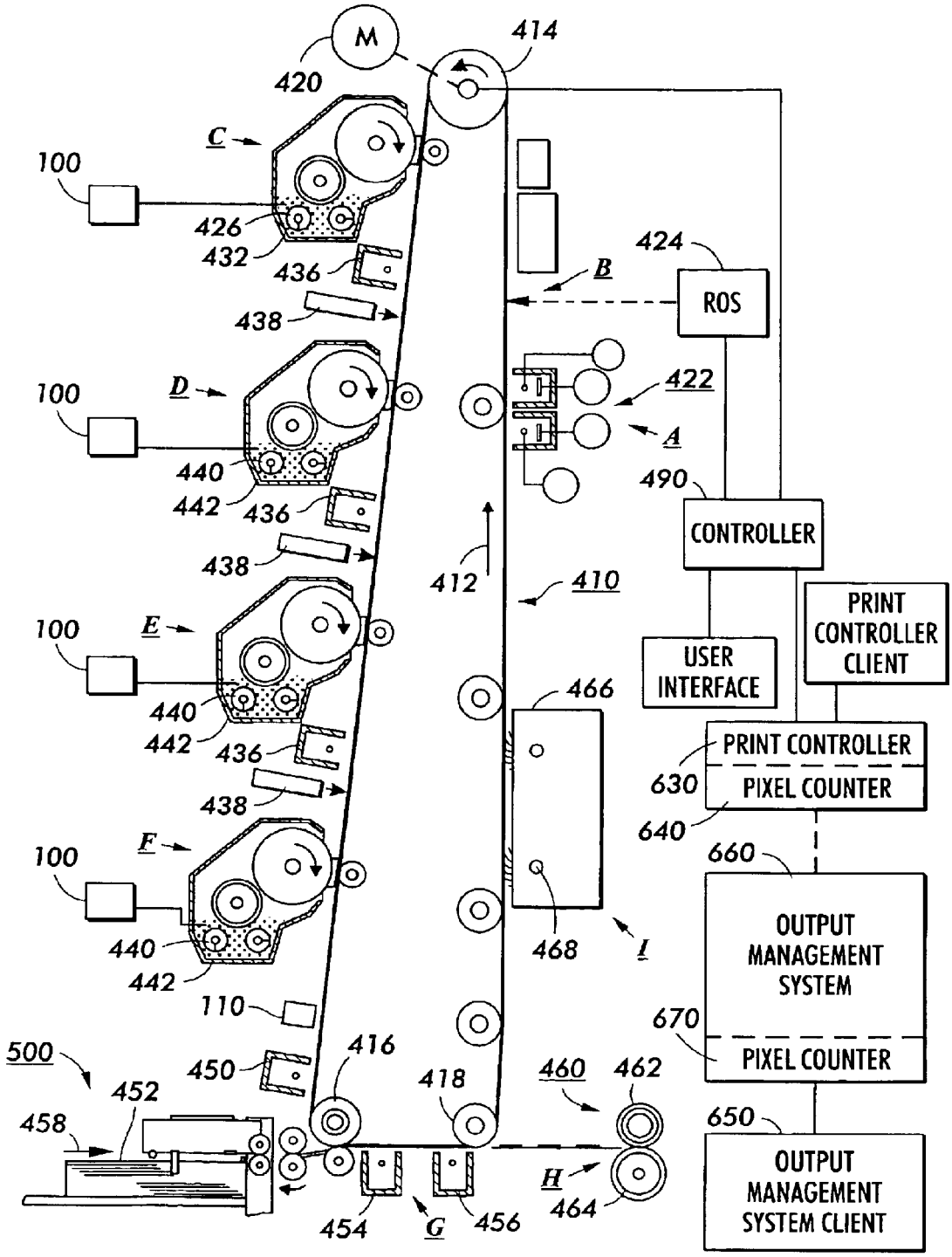
FIG. 2 is a schematic elevational view of the development system utilizing the invention herein.

Referring to FIG. 2, an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 830 to the Controller 490.

The printing system preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension roller 416 and fixed roller 418 and the drive roller 414 is operatively connected to a drive motor 420 for effecting movement of the belt through the xerographic stations. A portion of belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage V0, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or background areas.

At a first development station C, developer structure, indicated generally by the reference numeral 432 utilizing a hybrid development system, the developer roller, better known as the donor roller, is powered by two developer fields (potentials across an air gap). The first field is the AC field which is used for toner cloud generation. The second field is the DC developer field which is used to control the amount of developed toner mass on the photoreceptor belt 410. The toner cloud causes charged toner particles 426 to be attracted to the electrostatic latent image. Appropriate developer biasing is accomplished via a power supply. This type of system is a noncontact type in which only toner particles (black, for example) are attracted to the latent image and there is no mechanical contact between the photoreceptor belt 410 and a toner delivery device to disturb a previously developed, but unfixed, image. A toner concentration sensor 100 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels, and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles 440. Further, a toner concentration sensor 100 senses the toner concentration in the developer housing structure 442.

Figure 4:
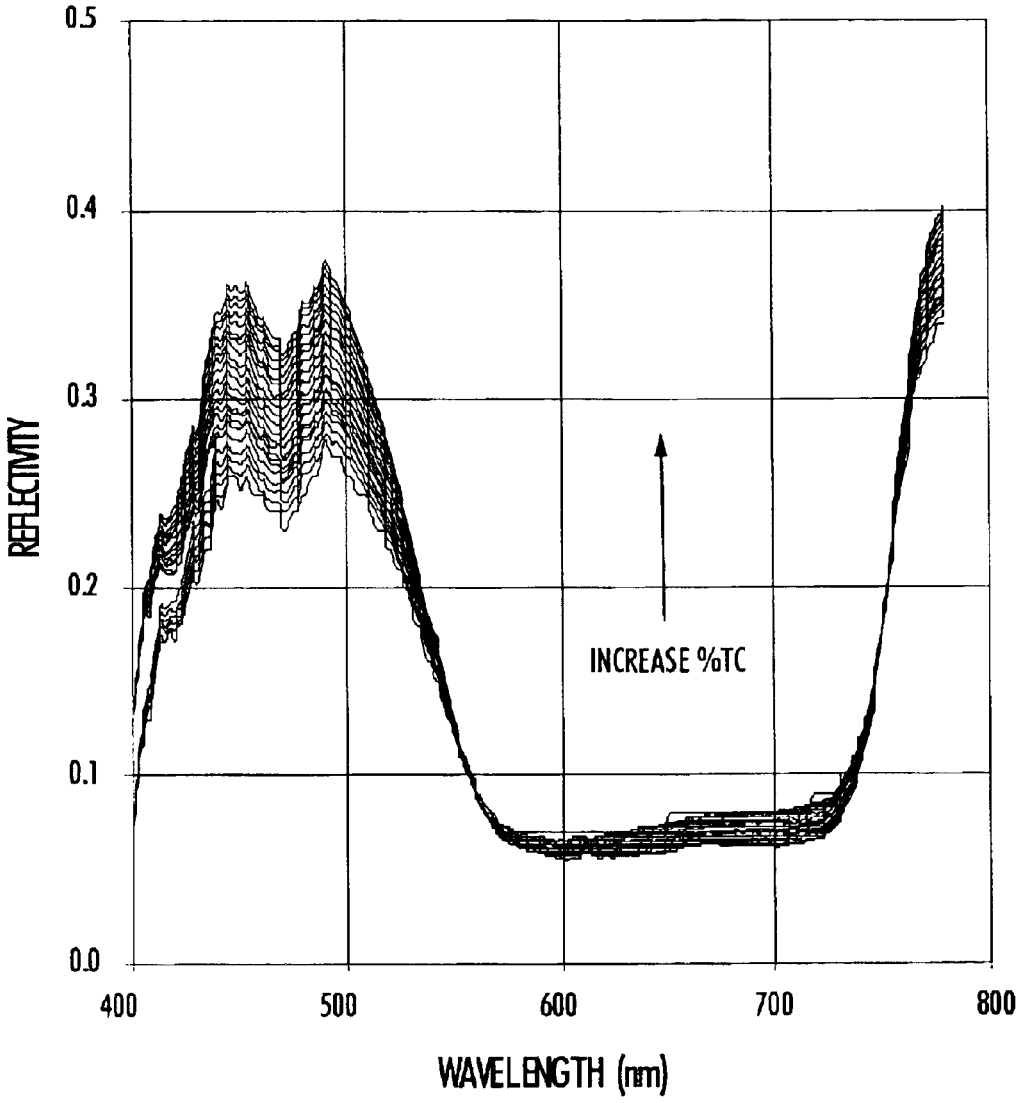
FIGS. 4–7 are graphs illustrating the dependence of reflectivity on toner concentration as a function of wavelength for various toners and carriers.
Figure 5:
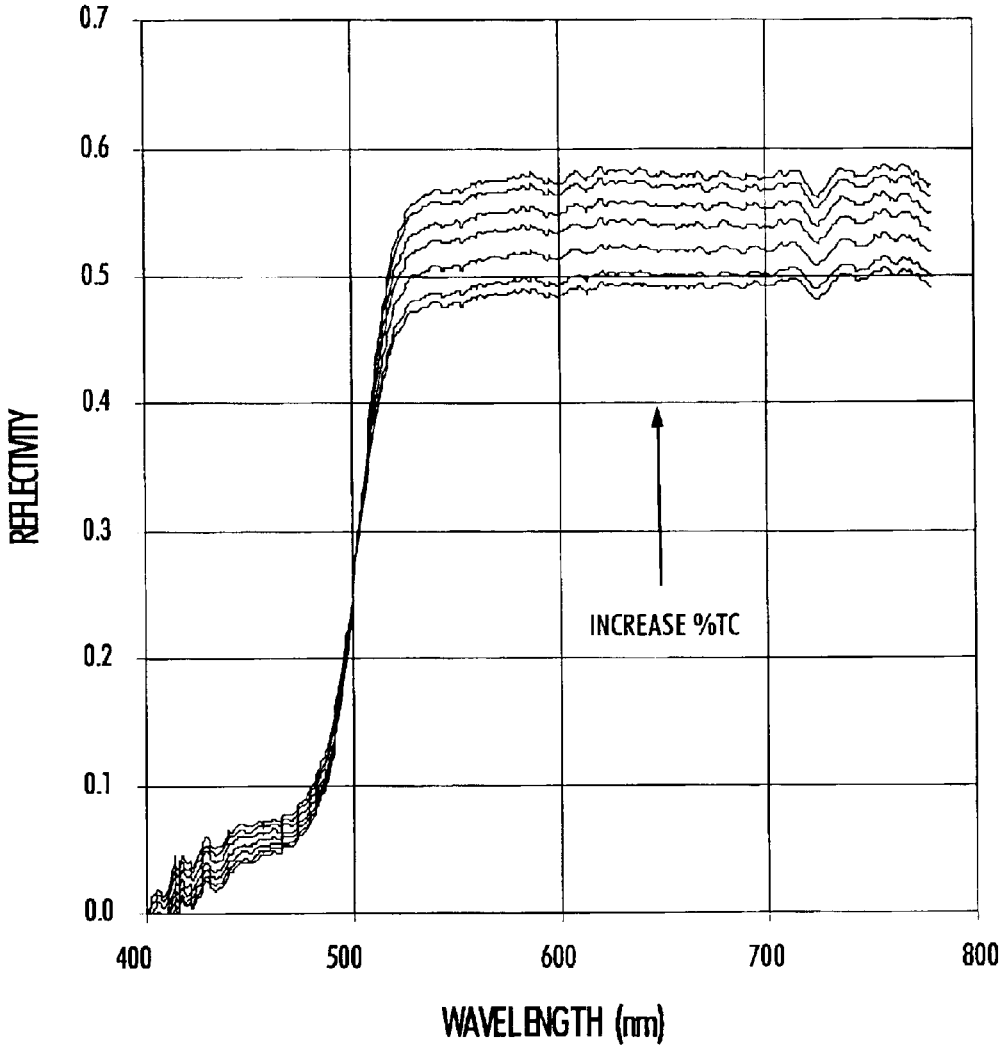
Figure 6:
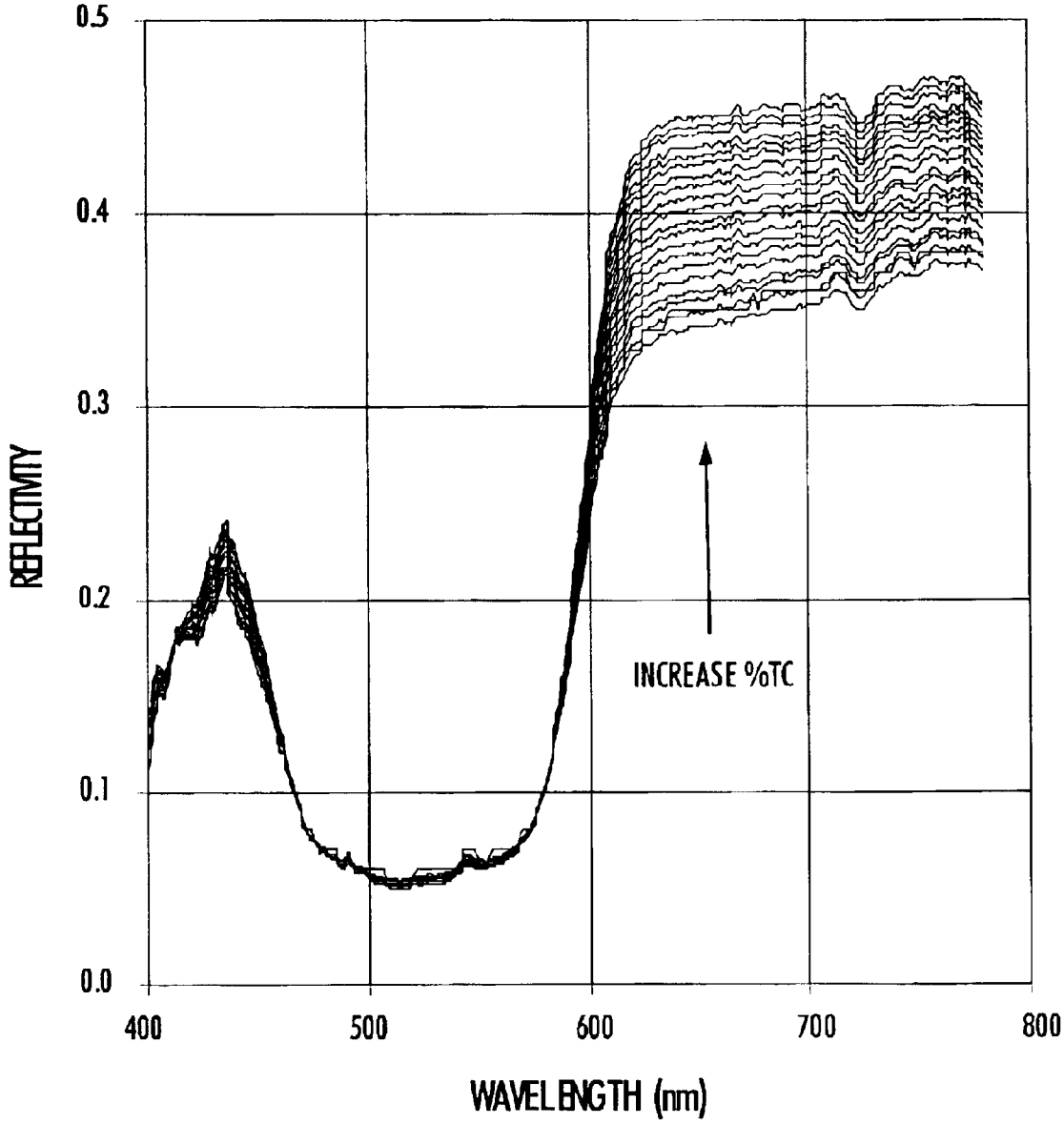

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 4, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor (not shown) which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and backup roller 464 with the toner powder image contacting fuser roller 462. In this manner, the toner powder images are permanently affixed to sheet 452. After fusing, a chute, not shown, guides the advancing sheet 452 to a catch tray, stacker, finisher or other output device (not shown), for subsequent removal from the printing machine by the operator.

After the sheet of support material 452 is separated from photoconductive surface of photoreceptor belt 410, the residual toner particles carried by the non-image areas on the photoconductive surface are removed therefrom. These particles are removed at cleaning station I using a cleaning brush or plural brush structure contained in a housing 466. The cleaning brush 468 or brushes 468 are engaged after the composite toner image is transferred to a sheet. Once the photoreceptor belt 410 is cleaned the brushes 468 are retracted utilizing a device incorporating a clutch (not shown) so that the next imaging and development cycle can begin.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

Now referring to the developer station, for simplicity one developer station will be described in detail, since each developer station is substantially identical. In FIG. 1, donor roller 40 is shown rotating in the direction of arrow 68, i.e. the 'against' direction. Similarly, the magnetic roller 46 can be rotated in either the 'with' or 'against' direction relative to the direction of motion of donor roller 40. In FIG. 1, magnetic roller 46 is shown rotating in the direction of arrow 92, i.e. the 'with' direction. Developer unit 38 also has electrode wires 42 which are disposed in the space between the photoconductive belt 10 and donor roller 40. A pair of electrode wires 42 are shown extending in a direction substantially parallel to the longitudinal axis of the donor roller 40. The electrode wires 42 are made from one or more thin (i.e. 50 to 100$\mu$ diameter) wires (e.g. made of stainless steel or tungsten) which are closely spaced from donor roller 40. The distance between the electrode wires 42 and the donor roller 40 is approximately 25$\mu$ or the thickness of the toner layer on the donor roller 40. The electrode wires 42 are self-spaced from the donor roller 40 by the thickness of the toner on the donor roller 40. To this end the extremities of the electrode wires 42 supported by the tops of end bearing blocks also support the donor roller 40 for rotation. The ends of the electrode wires 42 are now precisely positioned between 10 and 30 microns above a tangent to the surface of donor roller 40.

With continued reference to FIG. 1, an alternating electrical bias is applied to the electrode wires 42 by an AC voltage source 78. The applied AC establishes an alternating electrostatic field between the electrode wires 42 and the donor roller 40 which is effective in detaching toner from the surface of the donor roller 40 and forming a toner cloud about the wires, the height of the cloud being such as not to be substantially in contact with the photoconductive belt 10. The magnitude of the AC voltage is on the order of 200 to 500 volts peak at a frequency ranging from about 3 kHz to about 10 kHz. A DC bias supply 81 which applies approximately 300 volts to donor roller 40 establishes an electrostatic field between photoconductive surface of belt 10 and donor roller 40 for attracting the detached toner particles from the cloud surrounding the electrode wires 42 for the latent image recorded on the photoconductive surface 12. At a spacing ranging from about 10$\mu$ to about 40$\mu$ between the electrode wires 42 and donor roller 40, an applied voltage of 200 to 500 volts produces a relatively large electrostatic field without risk of air breakdown. The use of a dielectric coating on either the electrode wires 42 or donor roller 40 helps to prevent shorting of the applied AC voltage.

Magnetic roller 46 meters a constant quantity of toner having a substantially constant charge onto donor roller 40. This insures that the donor roller provides a constant amount of toner having a substantially constant charge as maintained by the present invention in the development gap.

A DC bias supply 84 which applies approximately 100 volts to magnetic roller 46 establishes an electrostatic field between magnetic roller 46 and donor roller 40 so that an electrostatic field is established between the donor roller 40 and the magnetic roller 46 which causes toner particles to be attracted from the magnetic roller 46 to the donor roller 40.

An optical sensor 200 is positioned adjacent to transparent viewing window 210 which is in visual communication with housing 44. Preferably, transparent viewing window 210 is positioned in a place where the developer material is well mixed and flowing near an auger supplying the magnetic roller 46 thereby a toner concentration representative of the overall housing 44 can be obtained.

Figure 3:
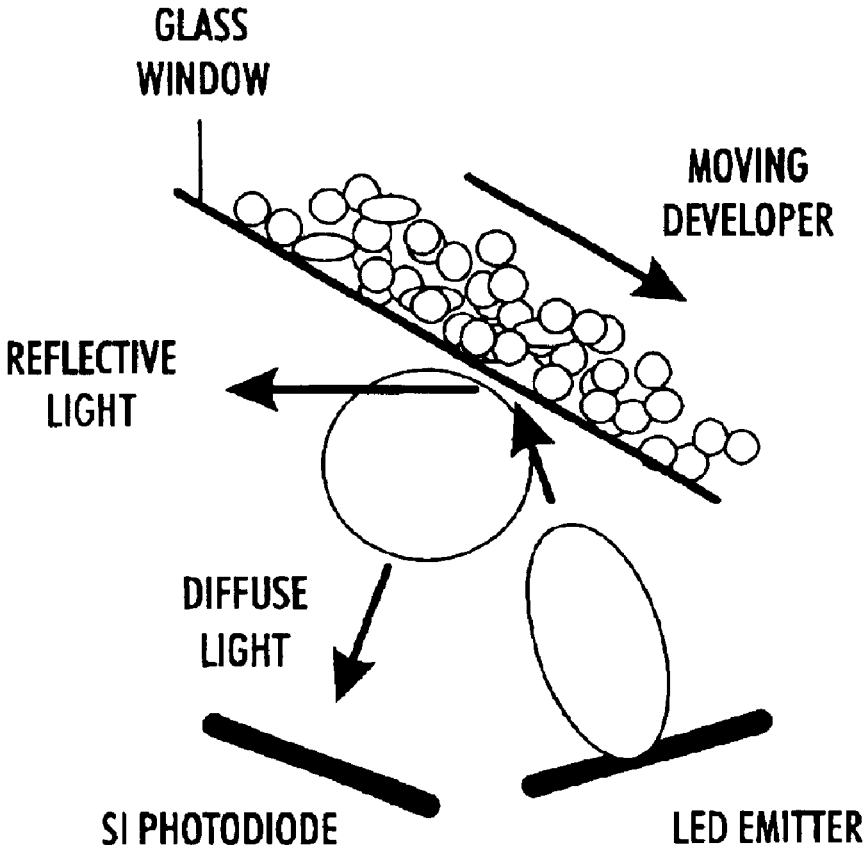
FIG. 3 is a schematic view of the optical % TC sensing device illustrating the measuring process proposed in the invention herein.

The optical sensor 200 is positioned adjacent the surface of transparent viewing window 210. The toner on transparent viewing window 210 is illuminated. The optical sensor 200 generates proportional electrical signals in response to electromagnetic energy, reflected off of the transparent viewing window 210 and toner on transparent viewing window 210, is received by the optical sensor 200. FIG. 3 illustrates the measuring process. In response to the signals, the amount of toner concentration can be calculated.

The optical sensor 200 detects specular and diffuse electromagnetic energy reflected off developer material on transparent viewing window 210. Preferably the optical sensor 200 is a type employed in an Extended Toner Area Coverage Sensor (ETACS) Infrared Densitometer (IRD) such as an optimized color densitometers (OCD), which measures material density located on a substrate by detecting and analyzing both specular and diffuse electromagnetic energy signal reflected off of the density of material located on the substrate as described in U.S. Pat. Nos. 4,989,985 and 5,519,497, which is hereby incorporated by reference. The optical sensor 200 is positioned adjacent the surface of transparent viewing window 210. The toner on transparent viewing window 210 is illuminated. The optical sensor 200 generates proportional electrical signals in response to electromagnetic energy, reflected off of the transparent viewing window 210 and developer material on transparent viewing window 210, is received by the optical sensor 200. In response to the signals, the amount of toner concentration can be calculated by controller 215.

In the present invention employs an optical approach that infers the % TC level in the developer housings by using the fact that there are particular regions of the optical spectra of each CMYK developer which show the larger changes as a function of % TC, therefore, by illuminating the developers with specific color lights matched to those regions one can achieve both increase responsivity to % TC changes per unit energy input, while maintaining simplicity in the device and dramatic cost reductions.

It has been found that the LED excitation sources having peak wavelengths in the range 400–500 nm or 750–850 nm for cyan, 500–800 nm for yellow, 600–800 nm for magenta, and 800–1000 nm for black, provide the highest responsivity for each developer housing. It should be evident that toner in one of the developer housing could be a custom color in this case, one could employ the wavelength Y,C,M,K suitable to the color space the custom color is in.

Figure 7:
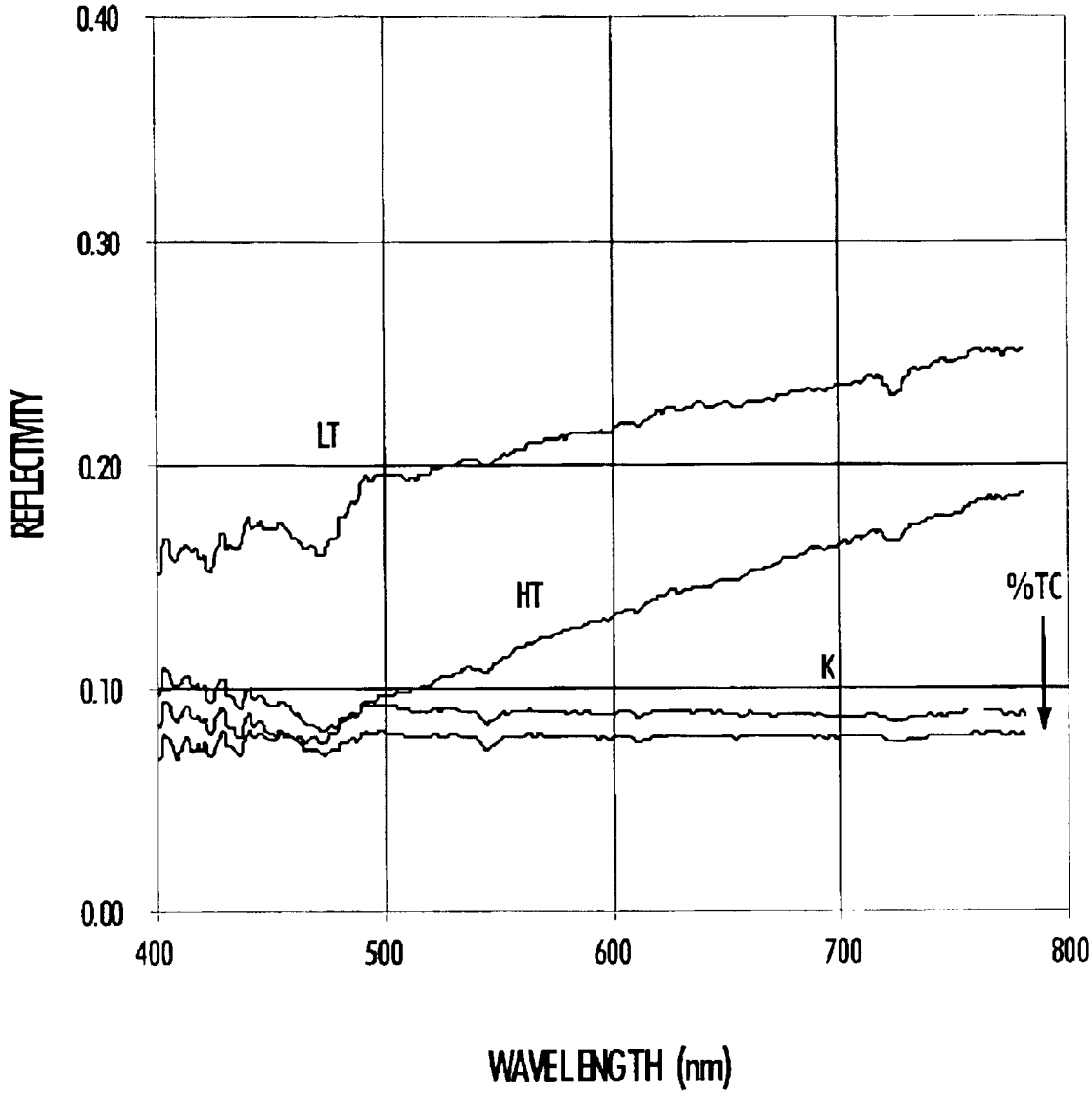

FIGS. 4, 5, 6, and 7 illustrate the change in optical spectra of cyan, yellow, and magenta developers, respectively, as a function of % TC in the 3–5% TC range. As expected by design, and illustrated in FIGS. 4–6, cyan, yellow, and magenta changes are larger in the 400–500 nm, 500–800 nm, and 600–800 nm regions. FIG. 7 shows the optical spectra of the black K-developer and the carrier. The figure shows that the optical spectra of K-toner is essentially flat, whereas the carrier shows increase reflectivity with increasing wavelength, strongly suggesting that the response to changes in K-% TC will be larger in the IR, i.e., for the K-developer housing we measure the carrier optical response and from that measurement we calculate the toner concentration.

The present invention teaches a method, the means and procedures, to accurately determine % TC in two components development systems for digital color printers. This method consists of hardware and software components as follows:

LED sources for each sensor has a wavelength matched for each development housing. These excitation sources should have peak wavelengths in the range: (a) 400–500 nm or 750–850 nm for cyan, (b) 500–800 nm for yellow, (c) 600–800 nm for magenta, and (d) 800–1000 nm for black.

Figure 9:
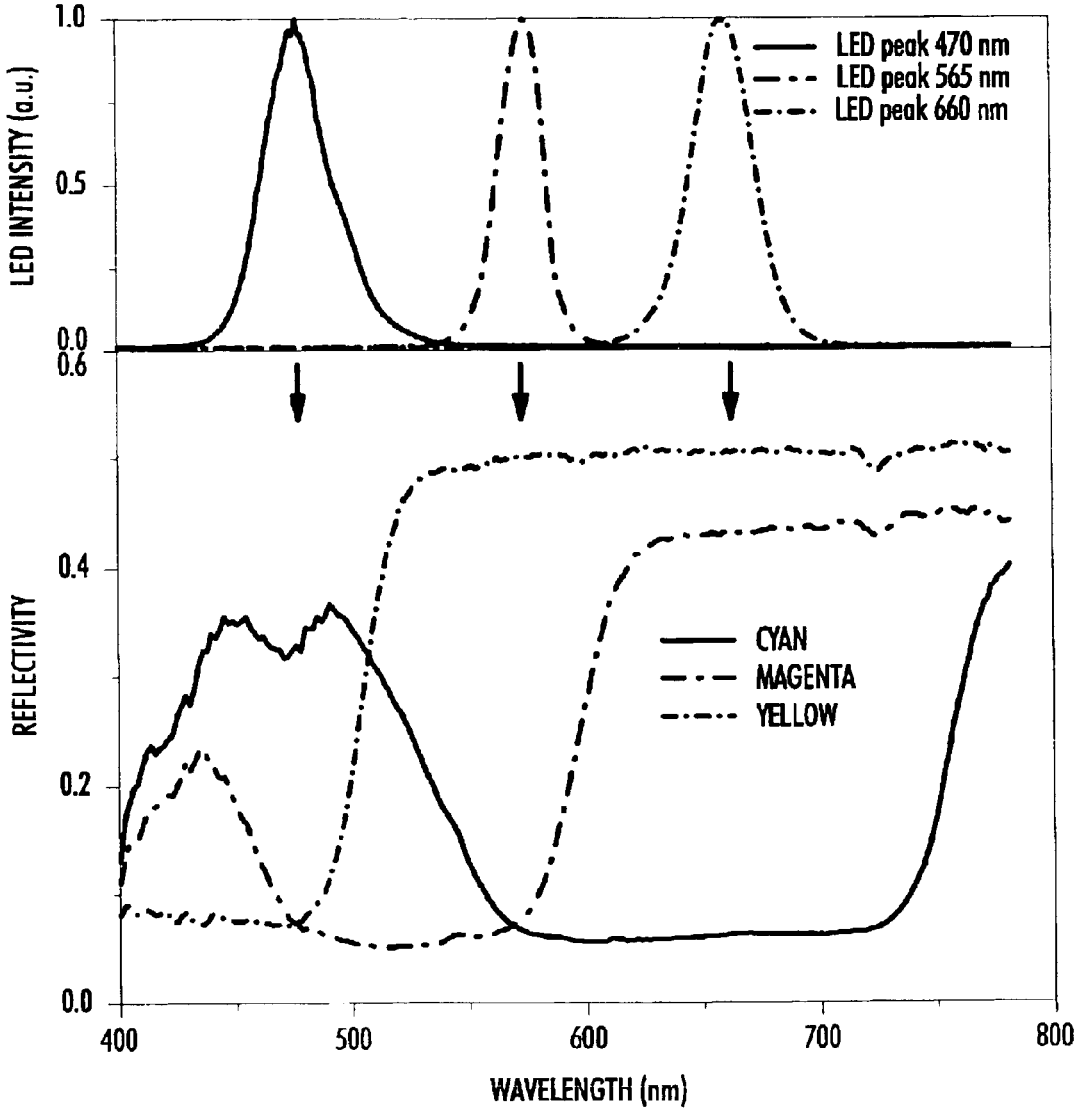
FIG. 9 is a graph illustrating combined plots showing the matching of specific LED with relevant regions of the spectra of the cyan, yellow and magenta developers at 5% TC.

FIG. 9 illustrates normalized reflectivity for cyan, yellow and magenta developers at ~5% TC, and the normalized spectral responsivity of 3 LED sources: 470 nm, 565 nm, and 660 nm (top panel) showing the matching of the LED peak wavelengths with relevant regions of the spectra of the toners.

The data depicted in FIGS. 4–9 provide components (besides some constants, see below) to determine the response of the proposed optical % TC sensor as follows:

$$\% \ TC_i = C_i \times \int_{\lambda_o}^{\lambda_1} R_{PD} E_i R_i d\lambda \tag{1}$$

Where i=C, M, Y, K

RPD is the normalized spectral responsively of the photodiode.

Figure 8:
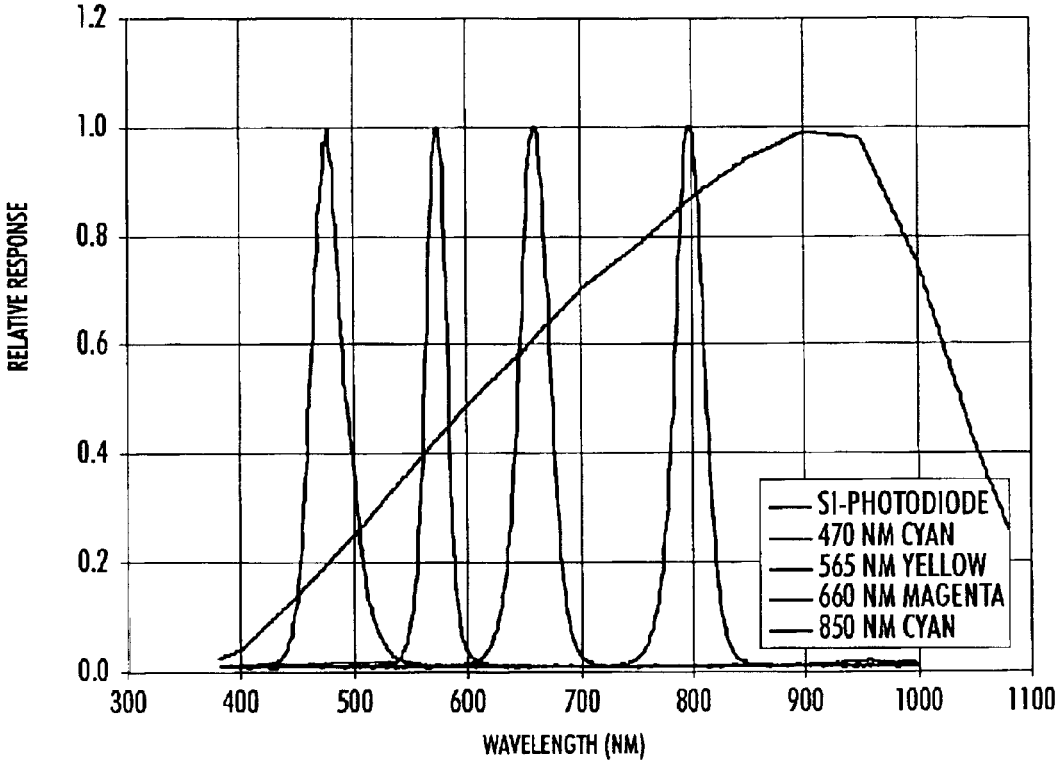
FIG. 8 is a graph illustrating normalized spectral responsivity of 4 LED sources with peak wavelengths 470 nm, 565 nm, 660 nm, and 790 nm and of Si-photodiode detector used in the calculations for determining the % TC of cyan, yellow and magenta developers.

Ei is the normalized spectral density of the i LED. FIG. 8 shows RPD as a function of wavelength for Si-photodiodes and for 4 LEDs.

Ci is a constant containing (a) optical path factors, (b) peak responsivity of the photodiode, (c) peak responsivity of the LED, (d) conversion factor from reflectivity to % TC, etc. These factors can be optimized according to S/N ratio, device cost, etc.

The results of the calculations are shown in FIG. 10. Then, for each particular developer and LED emitter set the equation (1) can be reduced to:

$$\%TC = K_i \times V_i \tag{2}$$

Where the Ki is a constant containing all the parameters for the particular set, and Vi is the voltage reading from the photodiode.

In recapitulation, there has been provided an electrophotographic color printing machine for producing color images, includes an imaging system for recording an image on an imaging member; a first developer unit for developing said image, said first developer unit including a sump for storing a quantity of developer material comprised of toner of a first color and carrier material, a member for transporting developer material from said sump, said sump including a viewing window, in communication with developer material, in said sump, an optical sensor, device for measuring reflected light off said viewing window and developer material, and means for generating a signal indicative of the toner concentration in said sump, said optical sensor including a light source and a light detector, said light source emitting light at a first predefine wavelength based upon said toner of said first color; and a second developer unit for developing said image, said second developer unit including a sump for storing a quantity of developer material comprised of toner of a second color and carrier material, a member for transporting developer material from said sump, said sump including a viewing window, in communication with developer material, in said sump, an optical sensor, device for measuring reflected light off said viewing window and developer material, and means for generating a signal indicative of the toner concentration in said sump, said optical sensor including a light source and a light detector, said light source emitting light at a second predefine wavelength base upon said toner of said second color.

It is, therefore, apparent that there has been provided in accordance with the present invention, that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An electrophotographic color printing machine for producing color images, comprising:

means for recording an image on an imaging member;

a first developer unit for developing said image, said first developer unit including a sump for storing a quantity of dry developer material comprised of toner of a first color and carrier material, a member for transporting developer material from said sump, said sump including a viewing window, in communication with developer material, in said sump, an optical sensor, device for measuring reflected light off developer material, a first auger for flowing developer across said viewing window; and means for generating a signal indicative of the toner concentration in said sump, said optical sensor including a light source and a light detector, said light source emitting light at a first predefine wavelength based upon said toner of said first color; and a second developer unit for developing said image, said second developer unit including a sump for storing a quantity of dry developer material comprised of toner of a second color and carrier material, a member for transporting developer material from said sump, said sump including a viewing window, in communication with developer material, in said sump, an optical sensor, device for measuring reflected light off developer material, a second auger for flowing developer across said viewing window; and means for generating a signal indicative of the toner concentration in said sump, said optical sensor including a light source and a light detector, said light source emitting light at a second predefine wavelength based upon said toner of said second color.

2. The electrophotographic color printing machine of claim 1, wherein said first color and second color are selected from the group consisting of cyan, magenta, yellow, black, and custom colors.

3. The electrophotographic color printing machine of claim 2, wherein said first predefined wavelength is between 400 and 500 nm or 750 and 850 nm when said first color is cyan.

4. The electrophotographic color printing machine of claim 2, wherein said first predefined wavelength is between 500 and 800 nm when said first color is yellow.

5. The electrophotographic color printing machine of claim 2, wherein said first predefined wavelength is between 600 and 800 nm when said first color is magenta.

6. The electrophotographic color printing machine of claim 2, wherein said first predefined wavelength is between 800 and 1000 nm when said first color is black.

7. The electrophotographic color printing machine of claim 1, wherein said source comprises a LED and said light detector comprises a SI photodiode.

8. The electrophotographic color printing machine of claim 7, further comprising a toner concentration controller includes means for correlating measurements from said optical sensor to a toner concentration measurement.

9. The electrophotographic color printing machine of claim 8, wherein said toner concentration controller determines said toner concentration measurement based upon the following equation:

$$\% \ TC_i = C_i \times \int_{\lambda_o}^{\lambda_1} R_{PD} E_i R_i d\lambda$$

Where i=C, M, Y, K

RPD is the normalized spectral responsively of the photodiode.

Ei is the normalized spectral density of the i LED.

Ci is a constant containing (a) optical path factors, (b) peak responsivity of the photodiode, (c) peak responsivity of the LED, and (d) conversion factor from reflectivity to % TC.

10. The electrophotographic color printing machine of claim 8, wherein said toner concentration controller adapted to receive a signal from said sensor and to generate an "add toner" signal to replenish toner in said sump to maintain a predefine toner concentration.

11. The electrophotographic color printing machine according to claim 1, wherein said viewing window comprises a glass window.

12. An electrophotographic color printing machine for producing color images, comprising:

means for recording an image on an imaging member;

a first developer unit for developing said image, said first developer unit including a sump for storing a quantity of developer material comprised of toner of a first color and carrier material, a member for transporting developer material from said sump, said sump including a viewing window, in communication with developer material, in said sump, an optical sensor, device for measuring reflected light developer material, and means for generating a signal indicative of the toner concentration in said sump, said optical sensor including a light source and a light detector, said light source emitting light at a first predefine wavelength based upon said toner of said first color;

a second developer unit for developing said image, said second developer unit including a sump for storing a quantity of developer material comprised of toner of a second color and carrier material, a member for transporting developer material from said sump, said sump including a viewing window, in communication with developer material, in said sump, an optical sensor, device for measuring reflected light off developer material, and means for generating a signal indicative of the toner concentration in said sump, said optical sensor including a light source and a light detector, said light source emitting light at a second predefine wavelength based upon said toner of said second color; and a toner concentration controller includes means for correlating measurements from said optical sensor to a toner concentration measurement, said toner concentration controller determines said toner concentration measurement based upon the following equation:

$$\%TC = K_i \times V_i$$

Where

Ki is a constant containing all the parameters for the particular colored developer and LED set, and Vi is the voltage reading from the photodiode.

* * * * *